US009561876B2

(12) United States Patent
Ehmer

(10) Patent No.: US 9,561,876 B2
(45) Date of Patent: Feb. 7, 2017

(54) APPARATUS FOR FORMING PACKAGING UNITS

(71) Applicant: KHS GmbH, Dortmund (DE)

(72) Inventor: Wilfried Ehmer, Dortmund (DE)

(73) Assignee: KHS GmbH, Dortmund (DE)

( * ) Notice: Subject to any disclaimer, the term of this patent is extended or adjusted under 35 U.S.C. 154(b) by 254 days.

(21) Appl. No.: 14/361,836

(22) PCT Filed: Oct. 2, 2012

(86) PCT No.: PCT/EP2012/004189
§ 371 (c)(1),
(2) Date: May 30, 2014

(87) PCT Pub. No.: WO2013/079133
PCT Pub. Date: Jun. 6, 2013

(65) Prior Publication Data

US 2014/0352868 A1 Dec. 4, 2014

(30) Foreign Application Priority Data

Dec. 2, 2011 (DE) ..... 10 2011 119 966

(51) Int. Cl.
*B65B 17/02* (2006.01)
*B65B 27/04* (2006.01)
(Continued)

(52) U.S. Cl.
CPC ..... *B65B 17/02* (2013.01); *B65B 27/04* (2013.01); *B65B 35/46* (2013.01); *B65B 35/54* (2013.01);
(Continued)

(58) Field of Classification Search
CPC ..... B65B 27/04; B65B 17/02; B65B 17/025; B65C 3/06; B65C 3/065; B65C 3/08; B65C 3/14; Y10T 156/1771; B41J 3/4073
(Continued)

(56) References Cited

U.S. PATENT DOCUMENTS 3,759,373 A * 9/1973 Werth ..... B65D 21/0205 206/139
7,726,464 B2 6/2010 Cerf
(Continued)

FOREIGN PATENT DOCUMENTS

DE 2331193 1/1975
DE 2331193 A1 * 1/1975 ..... B65D 21/0205
(Continued)

*Primary Examiner* — Carson Gross
(74) *Attorney, Agent, or Firm* — Occhiuti & Rohlicek LLP

(57) ABSTRACT

A handling apparatus includes a container input, a furnishing carousel, a furnishing module, an application element, and a grouping device. The furnishing carousel rotates about a central axis and has the furnishing module and application element nearby. The furnishing module applies a furnishing feature to a surface of a container, and the application element applies adhesive to the container on a surface outside that surface of a container that is provided with a furnishing feature. The grouping device, which is either a compartmenting or compacting device, is immediately after the furnishing carousel and/or an outlet apparatus. The grouping device groups, compacts, or temporary presses together containers. The container input is either a single-track container feed, a multi-track container feed, a single-track container stream, or a multi-track container stream.

14 Claims, 6 Drawing Sheets

(51) Int. Cl.

| | |
|---|---|
| ***B65B 35/46*** | (2006.01) |
| ***B65B 35/54*** | (2006.01) |
| ***B65C 3/14*** | (2006.01) |
| ***B65B 61/26*** | (2006.01) |
| ***B65C 3/06*** | (2006.01) |
| *B65B 61/20* | (2006.01) |
| *B65B 63/00* | (2006.01) |

(52) U.S. Cl.
CPC ..... *B65B 61/26* (2013.01); *B65C 3/06* (2013.01); *B65C 3/14* (2013.01); *B65B 61/20* (2013.01); *B65B 63/005* (2013.01); *Y10T 156/10* (2015.01); *Y10T 156/1771* (2015.01)

(58) Field of Classification Search
USPC ..... 220/23.4
See application file for complete search history.

(56) References Cited

U.S. PATENT DOCUMENTS

2002/0185212 A1* 12/2002 Schaupp ..... B65C 9/04 156/205
2006/0113020 A1* 6/2006 Giacomazzi ..... B65C 3/06 156/64
2010/0257819 A1* 10/2010 Schach ..... B41J 3/4073 53/411
2010/0308043 A1* 12/2010 Wimmer ..... B65B 17/02 220/23.4

FOREIGN PATENT DOCUMENTS

| | | | |
|---|---|---|---|
| DE | 2419990 | 11/1975 | |
| DE | 4013938 | 10/1991 | |
| DE | 4126212 | 2/1993 | |
| DE | 19712193 | 9/1998 | |
| DE | 20110763 | 6/2002 | |
| DE | 10163268 | 7/2003 | |
| DE | 10243701 | 3/2004 | |
| DE | 102006037105 | 2/2008 | |
| DE | 102009025824 | 11/2010 | |
| DE | 102009025824 A1 * | 11/2010 | ..... B65B 17/02 |
| DE | 102009044271 | 4/2011 | |
| EP | 2096039 | 9/2009 | |
| EP | 2 301 852 | 3/2011 | |

* cited by examiner

APPARATUS FOR FORMING PACKAGING UNITS

RELATED APPLICATIONS

This application is the national stage of PCT application PCT/EP2012/004189, filed on Oct. 2, 2012, which claims the benefit of the Dec. 2, 2011 priority date of German application 10 2011 119 966.0, the contents of which are herein incorporated by reference.

FIELD OF INVENTION

The invention relates to an apparatus for handling containers, and in particular, to an apparatus for bundling containers.

BACKGROUND

Containers, as described herein, include, for example, bottles, cans, tubes, pouches, being made from metal, glass and/or plastic. Such containers include PET bottles and other packaging elements, in particular those that are suitable for the filling of liquid or viscous products, and containers already combined into groups, i.e. multipack groups of containers.

Such containers have a contact region that is executed in a spherically arched manner. Because of the shape of this contact region, containers can roll off against one another around a peripheral path, i.e. at a "roll-off ring." With glass bottles that have been used many times, this can be seen, for example, from the wear ring that is usually recognizable in bright accentuation. In the case of PET bottles such "roll-off rings" can be arranged not only in the head region but in the foot region also.

It is known that containers such as glass bottles or PET bottles are capped after filling and then provided with one or more labels. To this end, one or more individual labels are, for example, applied to the container with an adhesive as shown, for example, in DE 40 13 938 or DE 197 12 193. It is also known for the container to be fully enveloped with a label sleeve, which is often called a roll feed label. DE 201 10 763 discloses such a sleeve labeler in which the sleeve label is taken from a storage roll, cut to a suitable length, and then stretched and pulled over the bottle. The length of sleeve then contracts so that the sleeve label sits tightly against the surface of the bottle.

The roll feed method and such an apparatus are known from DE 102 43 701. The bottle is wrapped in a label whose beginning is stuck to the container and whose end is stuck to the label's beginning.

Especially for the application of a plurality of individual labels to a bottle, it is known for the bottle to be aligned on the labeling device such that, for example, the belly and breast label, or the decorative image on the cap, are disposed in a defined position relative to one another. The bottles that are labeled in this way are often subsequently combined on packaging machines to form bundles. In particular, a group of bottles or containers, often four or six individual bottles, are wrapped in a film that is then shrunk to provide a stable sales unit.

In detail, the production of the bundles is effected e.g. in the manner that the containers are fed standing on a transport plane of a transporter and with their container axes oriented in vertical or essentially vertical direction in a bulk transport or in a wide container stream in which the containers are randomly oriented such that their distinctive container features and/or furnishing features can face any direction. This wide container stream is then converted into a plurality of single-track container streams by passageway division. The compartmenting of the containers that form the subsequent bundles or their container groups from the single-track container streams, the bringing together of the necessary number of containers to form a compacted container group in which the containers lie against one another by a plurality of envelope or peripheral surfaces, i.e. by the contact or touching surfaces, and the connecting of the containers of each container group to form the compact and firm as well as stable bundle, are carried out in further process steps.

The combining or forming of a plurality of articles into a group of articles and from the groups of articles to produce firm and/or transportable storage and transport units or bundles using shrink films (e.g., as described in U.S. Pat. No. 7,726,464) is known to the skilled person. One of the disadvantages of known methods is that the films used, and in particular the shrinking-on of the films by the application of heat or energy, causes considerable expense.

It has also already been proposed to produce transportable bundles by the containers that are formed to a container group being packed, i.e. connected together into a bundle, by a strapping that encompasses the container group in the manner of a loop (DE 10 2009 025 824, DE 10 2009 044 271, and DE 41 26 212), this constituting a particularly inexpensive and simple way of producing bundles or transport and storage units. The strapping can also be bonded with the containers.

One disadvantage of strapping, however, is that when one container is first removed from such a bundle, the remaining containers are no longer held together by the strapping. This is the case not only when the strapping is removed or cut but also when a container is removed from the bundle without severing the strapping.

Moreover transporting such bundles on a belt conveyor always presents the danger that cylindrical or chiefly cylindrical articles, such as cans, bottles or containers, assume a nesting position, i.e. slip into a gap in the adjacent row, due to vibration, impacts etc. With known bundles, a very high tension must be applied to the strapping in order to avoid this.

DE 10 2006 037 105, on the other hand, relates to a method for the combining of bottle packets in which a rotary star wheel that presses bottle necks into clips on flat carriers is provided on both sides of a track. The bottle packet is also wrapped with a tape or an envelope, which acts as a film.

According to DE 23 31 193, an adhesive is applied to containers in narrow surfaces or rows, with contiguous surfaces that are not provided with adhesive being intended to enable one to grip and carry the package. The containers stick to one another at the adhesive points. EP 2 096 039 also relates to containers being provided with an adhesive, with a shrink film also being disposed around the bottle packet however.

SUMMARY

The object of the invention is to provide an apparatus and a method for producing bundles of the type mentioned at the outset, whereby despite the lack of an enveloping film and/or despite the lack of strapping, the articles are always prevented, in a simple manner, from adopting a nesting position while being transported, and even after one or more articles have been removed from a bundle, the cohesion of the remaining articles in the bundle is maintained or can be restored.

The handling apparatus includes one or more furnishing carousels on which both one or a plurality of labels or print images and a contact adhesive and/or adhesive application is performed for the immediately subsequent compacting of the containers and bundle formation. For this purpose, the containers can be rotated about a vertical axis on the furnishing carousel, with ideally a suitable plurality of bottom guides or top guides provided at each handling position of a container on the furnishing carousel. Suitable bottom guides include baseplates and turntables. Suitable top guides holding-and-centering tulips.

As used herein, "containers" includes PET bottles, bottles, cans, tubes, pouches that are made from metal, glass and/or plastic. The term "containers" also refers to other packaging elements, in particular those that are suitable for the filling of liquid or viscous products, and containers already combined into groups, i.e multipack groups. The containers of the bundle are arranged in non-nesting position.

As used herein, the terms "contact adhesives" or "adhesives" refers to all materials or masses that facilitate an adhesive bond between containers, in particular compounds, materials or masses that, when applied in the liquid or semi-liquid state, form a self-adhesive coat and/or bring about an adhesive bond under the application of pressure and/or energy and/or after curing or cross-linking (including through application of energy). The terms "contact adhesives" and "adhesives" also includes multilayer materials, e.g. those comprising at least one carrier material that is coated with a material with which an adhesive bond between containers is possible, are therefore adhesively active on at least two sides. Such adhesive agents can also be referred to as "pads."

As used herein, an "adhesive" container is one that is provided with a contact adhesive and adhesive application. The contact adhesive and adhesive is preferably selected such that the containers can be detached from the bundle and separated from one another by hand and without damage.

It is conceivable for liquid adhesive agent to be applied by the application elements. It is possible to apply a low-viscosity UV-curing adhesive. A hot-melt adhesive would also be suitable. However, as it cools very rapidly, it could lose its adhesive properties before the containers of the bundle are sufficiently bonded to one another. A UV-curing adhesive is also beneficial due to the particularly easy setting of its desired properties.

A corresponding curing station or curing section is expediently provided downstream of the application elements statically or along a linear transporter above and, if necessary, also below. A curing station can, for example, be a tunnel with UV-lighting. The curing station is preferably arranged downstream of the handling apparatus, preferably at the linear transporter.

It is beneficial for the handling apparatus to have a furnishing carousel, an inlet apparatus and an outlet apparatus. The inlet apparatus may be configured as an inlet star-wheel, inlet screw etc.

An apparatus that holds the containers so that they cannot rotate should ideally be selected for the outlet apparatus. For example, an outlet star-wheel can be provided in whose pockets are disposed a rubber-like, anti-rotation surface or elements. Ideally an outlet star-wheel is provided with a suction element at each receptacle for a bottle or container, the suction elements being connected to a vacuum pump. Ideally, the vacuum supply is configured in such a way that it is only active within a defined angular range of the outlet star-wheel.

The inlet apparatus effects an adaptation of the incoming container stream to the pitch of the furnishing carousel such that the respective containers can be transferred to the furnishing carousel without a problem. The containers can be transported onward at predetermined intervals with the outlet apparatus.

It is expedient if the bottom guides are implemented as turntables, and/or with the top guides implemented at the holding end as packing-or-centering tulips. In this way the respective container is clamped between the turntable and the packing-or-centering tulip and is held securely in position.

A rotation of the individual container that is additional to the rotation about the axis of the furnishing carousel can be effected with the motorized drive of the turntable and/or of the top guide. Consequently, as it moves over its transport path, the container is rotated as required about the axis of rotation of the furnishing carousel and relative to the latter such that, in the peripheral direction of the container, furnishing features such as labels can be applied and a plurality of contact and touching surfaces of the container can also be provided with contact adhesive or adhesive.

It is an advantage if application elements are provided such that, when seen in the direction of rotation of the furnishing carousel, the elements follow one another. It is also an advantage if application elements are arranged both radially on the inside and radially on the outside, since the rotation time for the application of a plurality of quantities of contact adhesive or adhesive to the periphery of a container is thereby reduced.

By means of the drives, in interaction with suitable inspection devices, the standing containers can also be favorably aligned on certain container features and/or furnishing features, i.e. on so-called embossings for example, and then be container-specifically provided with contact adhesive and/or adhesive such that the containers of a bundle are accommodated within the bundle so as to be identically aligned relative to one another.

In a preferred embodiment, two application elements are arranged so that one is above the other, with any subsequent application elements being likewise arranged one above the other. Each application element can thus always provide precisely one container region, i.e. one section of the contact and touching surface, with contact adhesive and adhesive. The application elements can naturally be adjustable, i.e. adjustable in their inclination relative to each spatial axis, for example in the event of a spraying or sprinkling application of contact adhesive and adhesive. The application elements can also be entrained with the container concerned over at least a partial distance, although this is not absolutely necessary.

The handling apparatus, preferably the furnishing carousel or outlet apparatus, is immediately followed by a compartmenting or compacting section or compartmenting or compacting apparatus, e.g. a linear transporter, with the containers provided with the still wet or not-yet activated contact adhesive and adhesive being combined into bundles and transported onward. Static and/or moving guide elements can be provided on either side of the linear transporter and entraining elements may also be provided, each being associated with a bundle.

The guide elements are configured, for example, as guide rails that guide and support the bundles and/or the containers of the bundle between them. It is conceivable for the guide elements to be rigidly executed. It is, however, also possible for the guide elements to be configured as travelling elements such that the containers or bundles do not exhibit a speed relative to the laterally disposed guide elements. A lateral pressure for adhesively bonding the containers of the bundle can be generated with the laterally disposed guide elements. In other words, the guide elements not only have the function of guiding and supporting but also the function of generating a pressure acting on the containers that when looked at square to the transport direction compresses the containers or the bundle, i.e. draws them nearer to one another, pressing them against one another so as to effect an adequate adhesive bond.

In a preferred embodiment, the entraining elements are arranged square to the transport direction and extend fully across the linear transporter, such that when seen in transport direction, they are disposed behind the bundle such that they push the bundle along before them. As a result of this, a force is beneficially generated that assists an interconnection of the containers when seen in or against the transport direction, and that assists a compression.

In order to improve the bond between the containers of the bundle when seen not only square to the transport direction but in the transport direction as well, the entraining elements can impart to the containers or the bundles a speed acting relative to the transporter when seen in transport direction. If the conveying speed of the entraining element or elements is greater than the conveying speed of the linear transporter, this brings about a pushing or sliding of the containers or of the bundle from the inlet side towards the outlet side. It is apparent that the pushing force can increase the adhesive bond considerably.

In a preferred embodiment the entraining elements can be configured as a bar, i.e. as an entraining bar. The entraining elements may also be themselves driven and/or be in connection with the guide elements. In addition to the functions already mentioned, the guide elements could also assume the guiding function for the entraining elements. If the guide elements are driven, i.e. are provided to circulate, it is very much in the interest of the invention to rigidly attach the entraining elements to the guide elements, in which case the above mentioned relative speed could be generated by means of the guide element drive. The guide elements could also be adjustable in the transverse direction such that the apparatus is also adjustable for different container dimensions. The conveying speed of the linear transporter, of the guide elements and/or of the entraining elements can be individually adjusted, and suitable control centers or central control units of an overall installation can be used for this purpose.

It is possible also to provide the bundle in the region of the compartmenting and/or compacting unit with a carrying element, for example a handle, to which end suitable devices may be provided that are arranged downstream of the outlet side or at a suitable position on the linear transporter.

The carrying element can of course be attached to the bundle or between adjacent containers of a bundle with the aforementioned contact adhesive or adhesive by being glued in at same time during the compacting and convergence of the containers after the furnishing carousel or the outlet in the region of the compartmenting and/or compacting unit.

By these means, the invention provides an apparatus for producing a bundle that, despite the lack of an enveloping film and/or a strapping, prevents, in a simple manner, the containers from adopting a nesting position while being transported. The aforementioned film can thus be entirely dispensed with.

Even after one or more containers are removed from a bundle, the cohesion of the remaining containers in the bundle is maintained. Dispensing with a film or strapping band (filmless bottle pack) eases the burden on the environment by avoiding waste, so also saving on resources used to produce the films or strappings that are usually produced from plastic. The containers of a bundle are stuck directly to one another during transport, i.e. in the continuous operation of the apparatus for producing bundles, i.e. the packaging machine. A filmless bottle pack can also be achieved with a minimum adhesive application that exhibits an adequate bond of the individual containers to one another.

The particular advantage however lies in the fact that by providing application elements for contact adhesive and adhesive on a labeling carousel, the packaging machine and the customary shrinking tunnel can be dispensed with. This constitutes a considerable advantage from the viewpoint of both energy and cost.

In another aspect, the invention features an apparatus for handling containers and/or for producing bundles from labeled and/or decorated containers the apparatus comprising a handling apparatus, the handling apparatus comprising a container input, a furnishing carousel, a furnishing module, an application element, and a grouping device, wherein the furnishing carousel rotates about a central axis, wherein the furnishing module is in a region of the furnishing carousel, wherein the application element is in the region of the furnishing carousel, wherein the furnishing module applies a furnishing feature to a surface of a container, wherein the application element applies adhesive to the container on a surface outside that surface of a container that is provided with a furnishing feature by the furnishing module, and wherein the grouping device is selected from the group consisting of a compartmenting unit and a compacting section, wherein the grouping device is provided immediately after the furnishing carousel and/or an outlet apparatus, wherein the grouping device causes grouping, compacting, and temporary pressing together of a predetermined number of containers, and wherein the container input is selected from the group consisting of a single-track container feed, a multi-track container feed, a single-track container stream, and a multi-track container stream, whereby the containers are combined to form a bundle and transported onward.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of an embodiment example with reference to the figures. In the figures.

DETAILED DESCRIPTION

Figure 1:
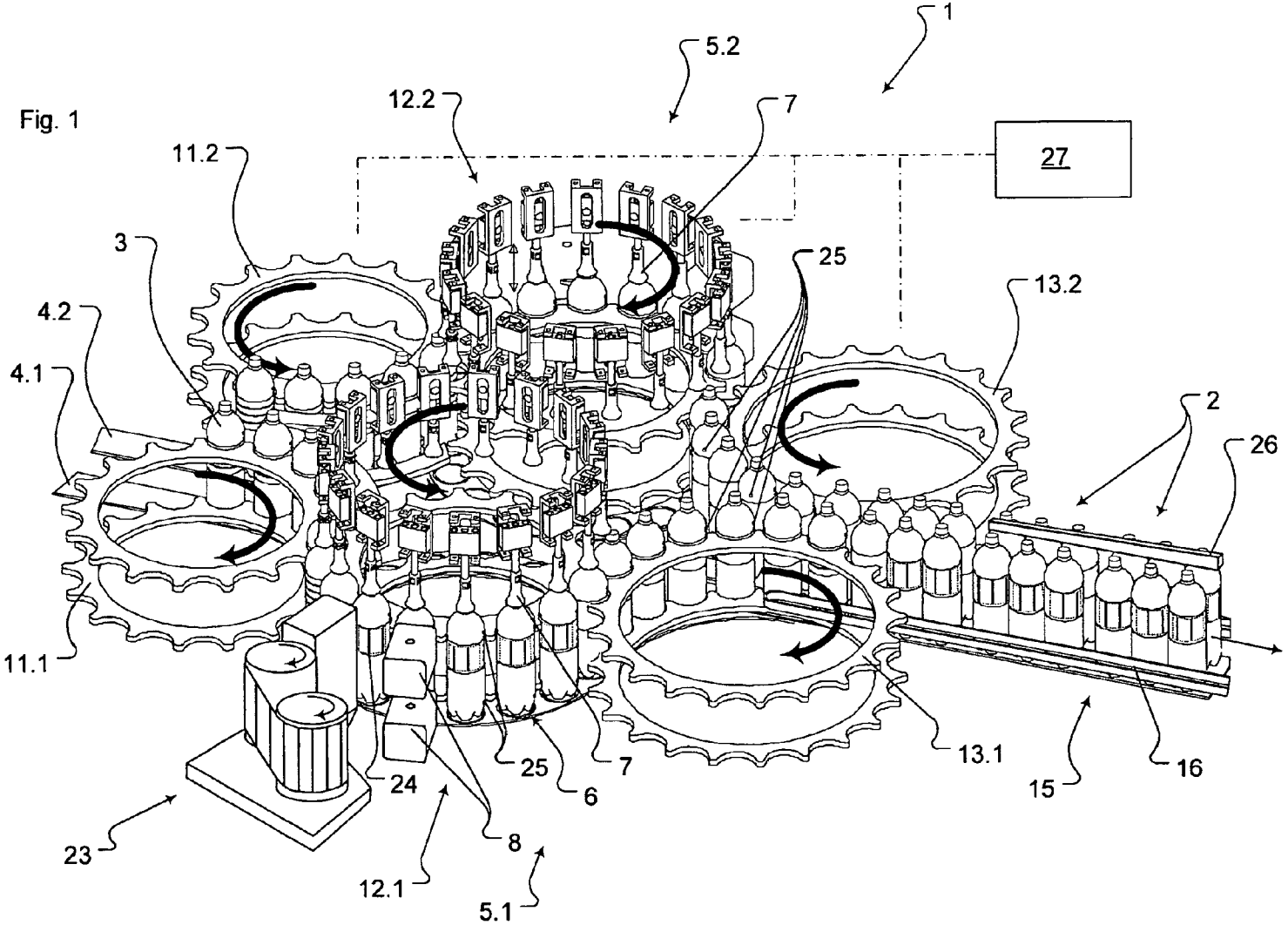
FIG. 1 shows, in perspective view, a partial section of an apparatus for producing a bundle having six articles or containers.

FIG. 1 shows a partial section of an apparatus 1 for producing bundles 2 from containers 3, i.e. of a packaging machine, with containers 3 first being converted from a wide container stream into a plurality of, as depicted for example, into two, single-track container streams 4.1 and 4.2 in which containers 3 have an arbitrary orientation. With a suitable and constructionally adapted compartmenting and compacting section or compartmenting and compacting section apparatus, it is equally possible to configure a single-track or a more than twin-track installation with the use of the following embodiments.

In the present example, a handling apparatus 5, 5.1, 5.2 is provided for each of container streams 4.1 and 4.2, with each respective handling apparatus 5.1, 5.2 having a plurality of bottom guides 6 and top guides 7 for containers 3. Along the transport path of the containers 3, one furnishing module 23, as a labeling module, is first provided at each handling apparatus or at its furnishing carousel 12, 12.1, 12.2 and subsequently two application elements 8 are arranged. In the embodiment depicted in FIG. 1, application elements 8 are arranged in such a way that the contact adhesive and adhesive can be dispensed onto the surface of the bottle above and below the label. Containers 3 are combined into bundles 2 downstream of the handling apparatus 5.

Containers 3 are transported from an inlet side 9 towards an outlet side 10 (axial transport direction 14), with furnishing modules 23 and application elements 8 being provided at the handling apparatus 5 for the application of contact adhesive or adhesive, and with containers 3 being combined to form a complete bundle 2 downstream of handling apparatus 5 and transported towards an outlet side 10.

FIG. 1 shows that each handling apparatus 5 or 5.1 and 5.2 exhibits an inlet apparatus 11 or 11.1 and 11.2, furnishing carousel 12, or 12.1 and 12.2 and an outlet apparatus 13 or 13.1 and 13.2 for respective container track 4.1 and 4.2. The inlet apparatus 11 is implemented as an inlet star-wheel and the outlet apparatus 13 is implemented as an outlet star-wheel. Because a handling apparatus 5 is provided for each of container track 4.1 and 4.2, they or their components are provided in the figures with the auxiliary number ".1" or ".2" to indicate the association with respective container track 4.1 and 4.2. The respective components are, as a rule, identically configured but could if necessary also be differently formed or dispensed with if technically expedient. On one of the two transport paths for example, it may be possible to provide no application elements 8 if the application of contact adhesive and adhesive 25 on the other transport path were sufficient.

In one embodiment, the bottom guides 6 on the furnishing carousel 12 are implemented as motor-driven turntables, and the top guides 7 are implemented as packing-or-centering tulips that are mounted at the holding end, or configured as such. A container 3 is thus held securely in position between a turntable 6 and a corresponding packing tulip 7. As stated previously, such turntables and packing-or-centering tulips are known from industrial labeling machines.

Figure 2:
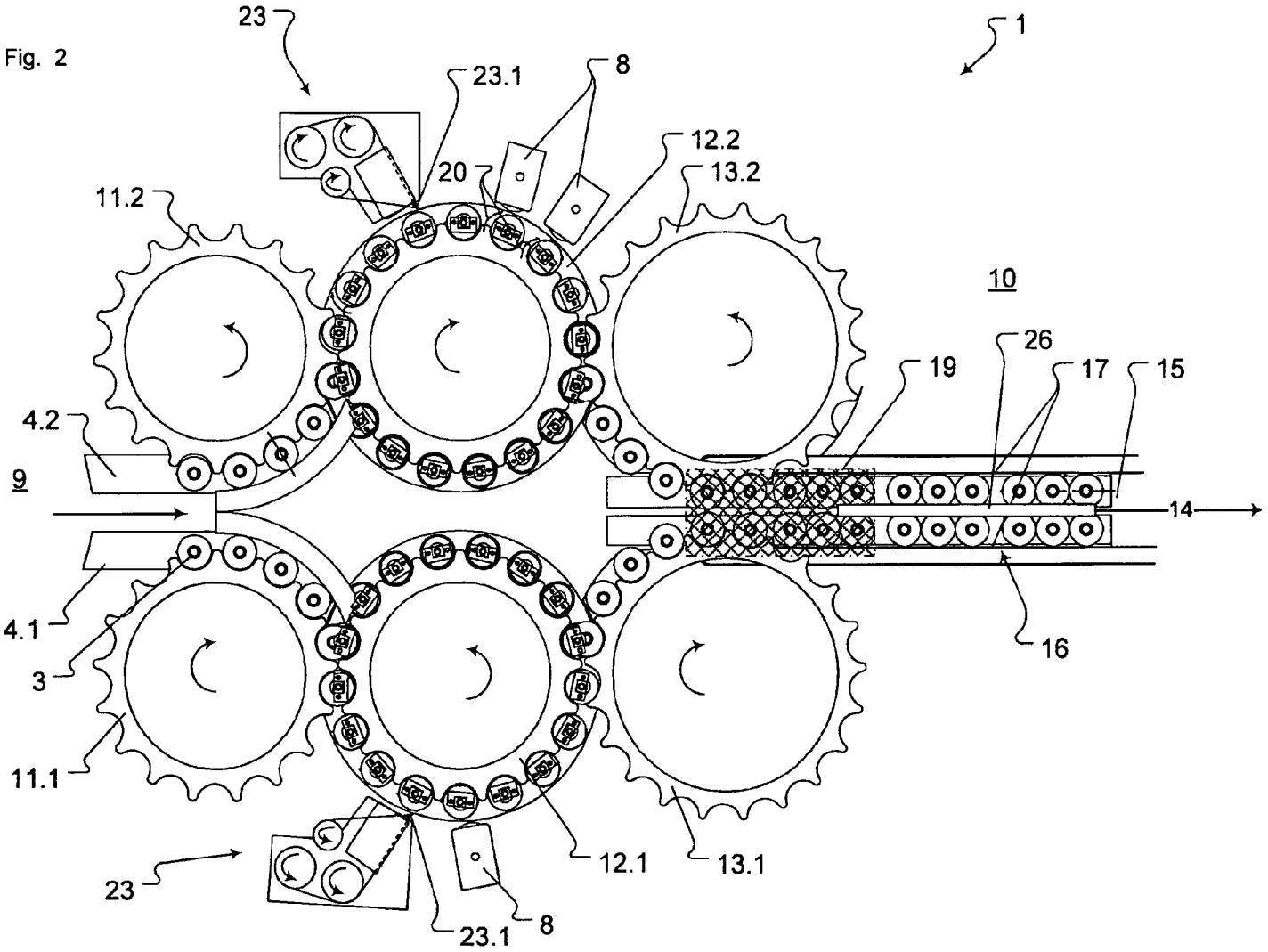
FIG. 2 shows, in plan view, the partial section of FIG. 1

As can be seen in each of FIGS. 1 and 2, there are provided a furnishing module 23 and application elements 8. In the illustrated embodiment, the furnishing module 23 is a labeling module that dispenses self-adhesive labels for a dispenser head 23.1. The application elements 8, which are at the furnishing carousel 12, follow one another when seen in the direction of rotation (arrow 18) of the furnishing carousel 12. By using the turntable 6, it becomes possible to align a standing container so that certain container and/or furnishing features, e.g. embossings, are positioned in a desired orientation and to apply contact adhesive or adhesive such that the containers 3 of a bundle 2 are aligned exactly identically with one another. Suitable inspection devices (not shown) can be provided to ensure that this is the case.

The containers can also be rotated so as to provide contact adhesive and adhesive at a plurality of contact and touching surfaces, for example fixed 90° increments around the periphery of the container. An aligning or rotating for example at and/or between application elements 8 following in direction of rotation 19 is indicated by reference character 20 in FIG. 2.

In a preferred embodiment, two application elements 8 are arranged one above the other, with subsequent application elements 8 being likewise arranged one above the other. Each application element 8 can thus always provide precisely one container region, i.e. one section of the contact and touching surface, with contact adhesive and adhesive. The application elements 8 can naturally be actuated for adjustment so that they can be adjusted, for example, in their inclination relative to each spatial axis, for example in the event of a spraying or sprinkling application of contact adhesive and adhesive. The application elements 8 can also travel with a container 3 for at least part of the distance traversed by the container 3. However, this is not normally necessary.

A linear transporter 15, which functions as a compartmenting and/or compacting section 22, is arranged immediately downstream of the outlet apparatus 13 or of both outlet star-wheels 13.1 and 13.2. The outlet apparatus 13 or the two outlet star-wheels 13.1 and 13.2 bring adhering containers 3 together square to an axial transport direction 14 and transfer adhering containers 3 in pairs to a linear transporter 15, as depicted in FIG. 2 by reference character 19.

Figure 4:
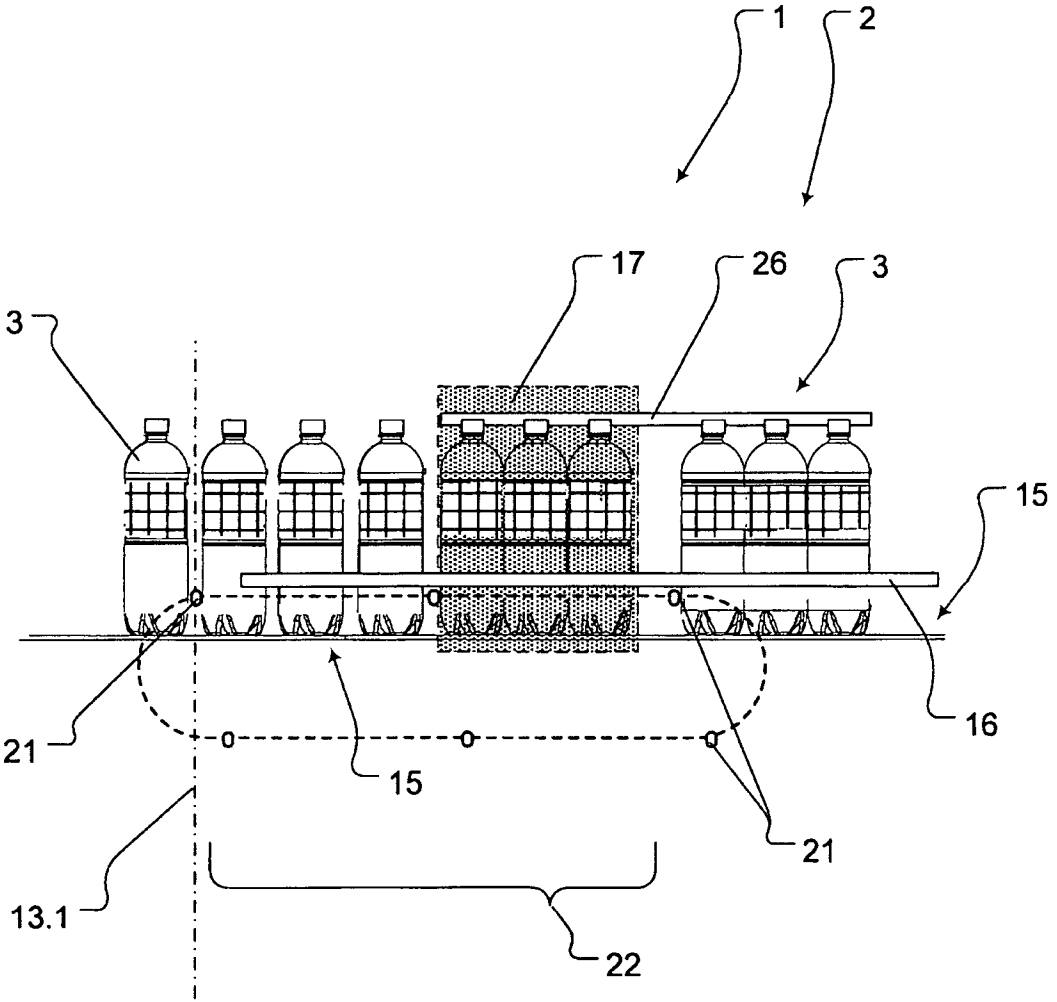
FIG. 4 shows an exemplary embodiment of a compartmenting or compacting section in the exemplary embodiment as a linear transporter.

In the process, two adhering containers 3 are first pressed together at their contact-and-touching surfaces. The linear transporter 15 is configured to combine a plurality of container pairs to form a bundle 2. For example, when three container pairs are combined, the bundle 2 will have six containers 3. For this purpose, the linear transporter 15 may have entraining elements 21, and, in addition, lateral guide elements 16 as depicted in FIG. 4. All components are interconnected via a regulating-and-control unit 27.

Figure 3:
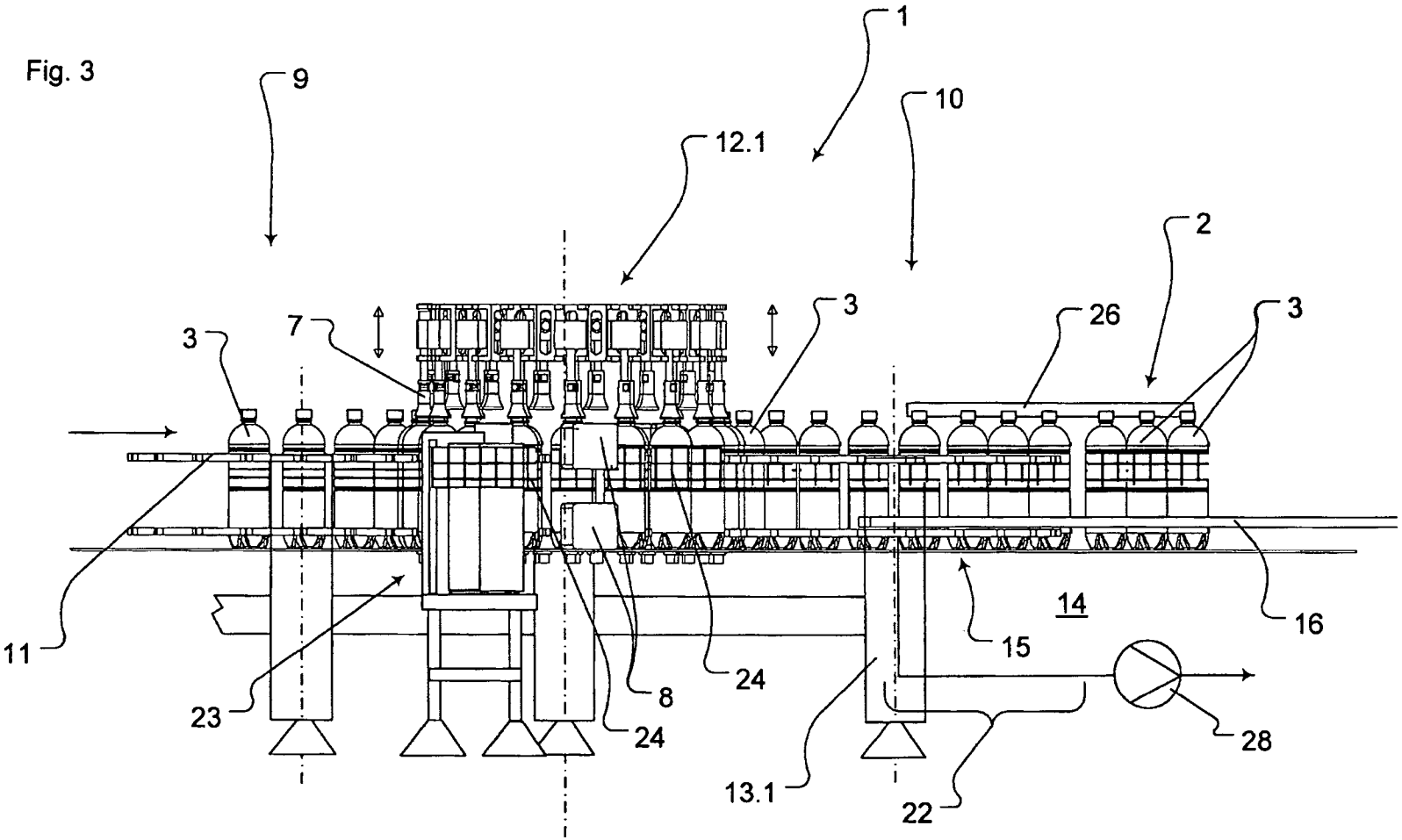
FIG. 3 shows, in side view, the partial section of FIG. 1.

As shown in FIG. 3, the outlet apparatus 13 is ideally connected to a vacuum pump 28 and has suction elements (not shown) that hold containers 3 in a defined and invariable rotational angle position. Ideally the containers 3 are not released until there has been contact with an adjacent container 3.

In a simpler embodiment, the outlet apparatus 28 has recesses and/or surfaces that, by virtue of their enhanced coefficient of friction, avoid or prevent rotations of containers 3. Examples of such recesses and/or surfaces include a rubberizing or tooth-like moldings, or a combination thereof.

A linear transporter 15 follows the handling apparatus 5 or outlet apparatus 13. The linear transporter 15 functions as a compartmenting and compacting section. Static and/or moving guide elements 16 are disposed on either side of the linear transporter 15.

In the present example, entraining elements 21 are provided, each of which is associated with a bundle 2. The entraining elements 21 bring together containers along the axial transport direction 14, for example by pressing together containers 3 of a bundle 2. The guide elements 16 also exert a pressing force on the containers 3 in a direction square to transport direction 14. This results in holding the containers together for a defined length of time, which favorably influences formation of a good adhesive bond.

In some embodiments, there is a need for a curing station 17, such as a UV curing station for UV-curing adhesive. This curing station 17 is beneficially positioned on the linear transporter 15. Alternatively or in combination, a UV radiator 26 that extends along the transport direction can be arranged above the grouped containers or above the bundles 3.

Figure 5:
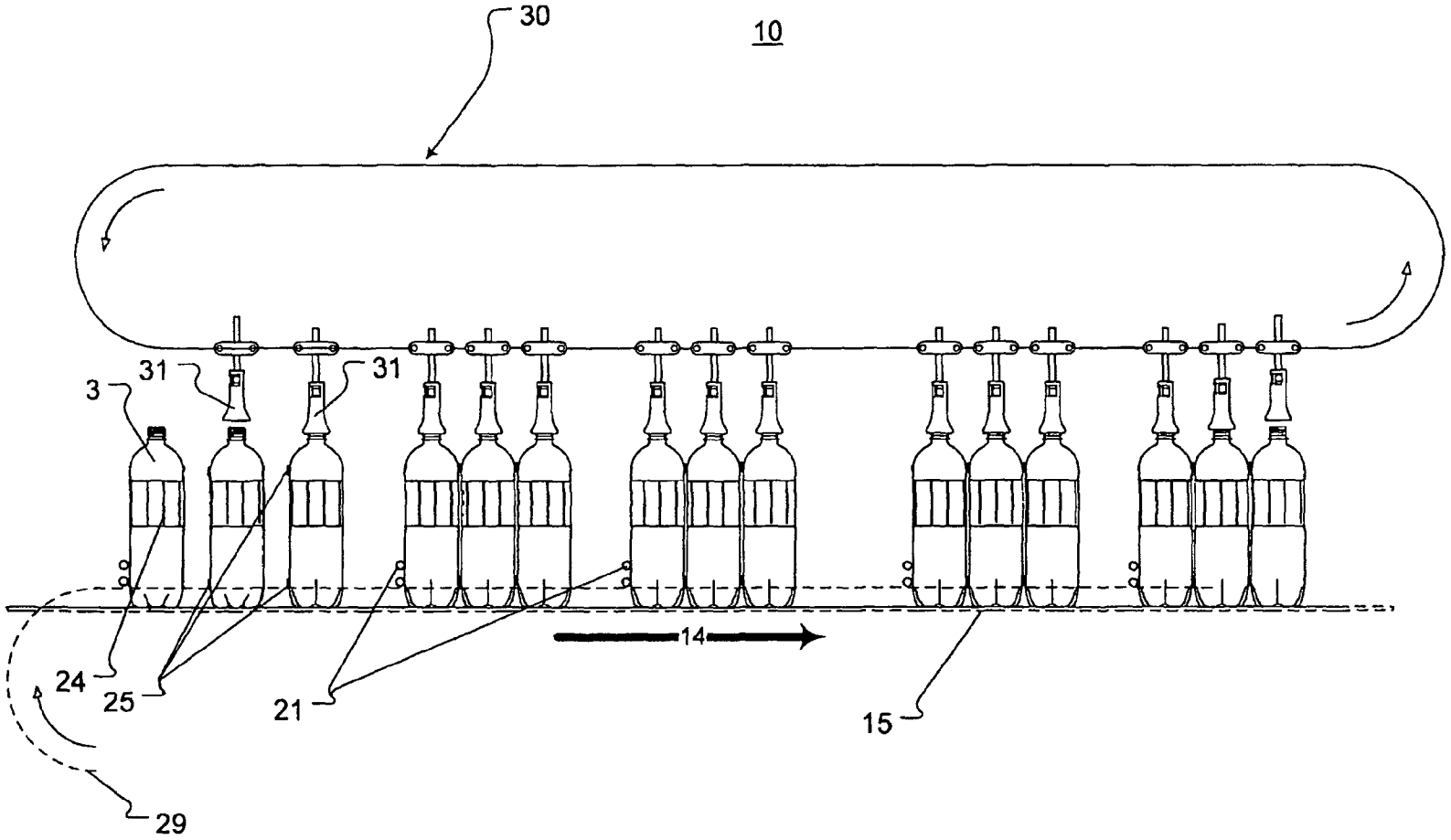
FIG. 5 shows a side view of an alternative linear compartmenting and compacting section.
Figure 6:
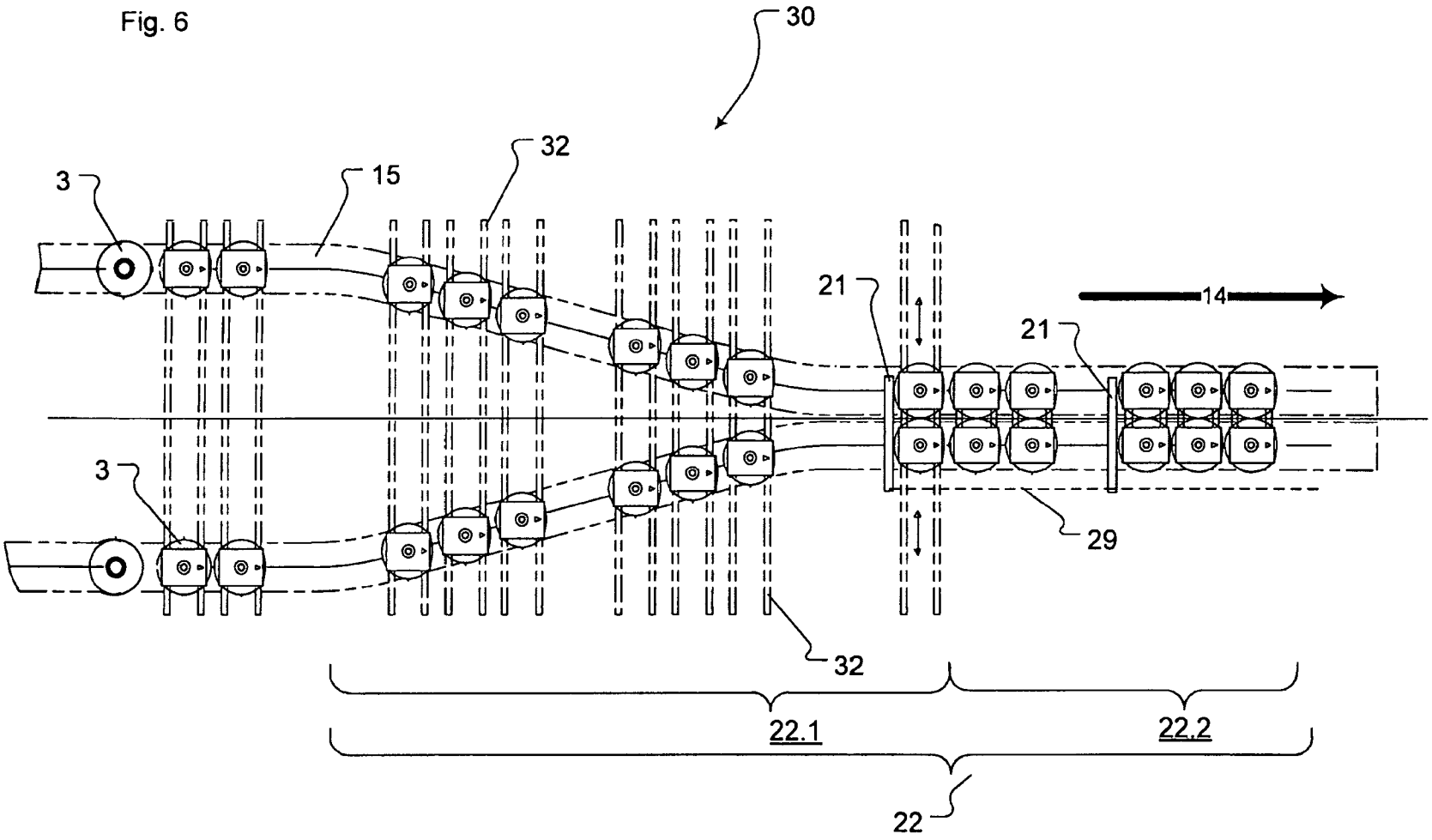
FIG. 6 shows a plan view of the top drive of a linear compartmenting and compacting section In the different figures, the same reference character in each case identifies identical parts, which is why they are generally described only once.

An alternative compacting station is shown in FIGS. 5 and 6. In the illustrated embodiment, the containers 3 have not already been pushed through outlet elements 13 in pairs square to the transport direction and brought into contact. After the furnishing carousel 12 and, as the case may be, after an outlet element 13, interspaced containers 3 are passed to a linear transporter 15 within whose region are disposed an endlessly circulating top drive 30 with centering tulips 31 that can be raised and lowered, and/or an endlessly circulating bottom drive 29 with entraining elements 21 by which containers 3 are anti-rotationally and positionally stably guided and moved closer to one another. In the example in FIG. 5 the two drives run in parallel virtually over the entire length of the compacting and compartmenting unit.

In the example shown in FIG. 6, centering tulips 31 of the top drive 30 are first lowered down onto containers 3, with the endlessly circulating top drive 30 moving the centering tulips 31 in the transport direction at the same transport speed as that of the linear transporter 15. In a partial length section 22.1 of the compartmenting and compacting section 22, the anti-rotationally held containers 3 are moved sideways and a container 3 is connected with an adjacent container 3. The centering tulip 31 travels square to the transport direction 14 while being held in transverse guides 32. During or immediately following contact, containers 3 that are connected in this way are released out of their restraint by the centering tulip 31, which is raised by cams (not shown) and retracted outwards.

Simultaneously with or immediately after the aforesaid release of the centering tulips 31 in the case of a third and final container pair of a desired container group that is to form a bundle 2, the entraining element 21 is brought closer by a bottom drive 29. The speed of the bottom drive 29 is greater than the previous transport speed or than that of the linear transporter 15 in the region of the second partial length 22.2 of the compartmenting and compacting section 22 such that the container group is accelerated and compacted to form a bundle 2. The curing or drying of a contact adhesive or adhesive 25 is thus carried out according to the embodiment above. Alternatively the first container pairs can be stopped or retarded in their transport speed until all container pairs of a bundle 2, here three per bundle 2, are in contact.

A variant in which the group of containers 3 belonging to a bundle 2 are held by centering tulips 31 until the rearmost of the container pairs that belong together is connected, or in which containers 3 are guided and held by their heads until the bundle is finally formed, i.e. including the compacting in transport direction, is not shown.

LIST OF REFERENCE CHARACTERS

1 Apparatus for producing labeled bundles
2 Bundle
3 Container
4 Container track (4.1 and 4.2)
5 Handling apparatus
6 Bottom guide
7 Top guide
8 Application elements
9 Entry end
10 Outlet side
11 Inlet apparatus
12 Furnishing carousel
13 Outlet apparatus
14 Axial transport direction
15 Linear transporter
16 Guide elements
17 Curing station
18 Direction of rotation of 12
19 Bringing together of 3 from 13 to 15
20 Rotation of 3
21 Entraining elements
22 Compartmenting and/or compacting unit/section
23 Furnishing module 23.1 dispenser head
24 Furnishing area
24.1, 24.2 Furnishing feature
25 Contact adhesive or adhesive
26 UV radiator
27 Regulating and control unit
28 Vacuum pump
29 Bottom drive
30 Top drive
31 Centering tulips
32 Transverse guides

The invention claimed is:

1. An apparatus for handling containers and/or for producing bundles from labeled and/or decorated containers said apparatus comprising a handling apparatus, said handling apparatus comprising a container input, a furnishing carousel, a furnishing module, an application element, and a grouping device, wherein said furnishing carousel rotates about a central axis, wherein said furnishing module is in a region of said furnishing carousel, wherein said application element is in said region of said furnishing carousel, wherein said furnishing module applies a furnishing feature to a surface of a container, wherein said application element applies adhesive to said container on a surface outside that surface of a container that is provided with a furnishing feature by said furnishing module, and wherein said grouping device is selected from the group consisting of a compartmenting unit and a compacting section, wherein said grouping device is provided immediately after said furnishing carousel and/or an outlet apparatus, wherein said grouping device causes grouping, compacting, and temporary pressing together of a predetermined number of containers, and wherein said container input is selected from the group consisting of a single-track container feed, a multi-track container feed, a single-track container stream, and a multi-track container stream, whereby said containers are combined to form a bundle and transported onward.

2. The apparatus of claim 1, wherein said handling apparatus further comprises a dispenser head for furnishing features of said furnishing module, wherein said application element is offset in a vertical direction relative to said dispenser head.

3. The apparatus of claim 1, wherein said furnishing carousel comprises a labeling carousel, wherein said furnishing module is a labeling module, and wherein said furnishing feature includes a label.

4. The apparatus of claim 1, wherein said furnishing carousel comprises a printing carousel, wherein said printing carousel comprises circulating print stations and print heads, wherein said furnishing module is said one or a plurality of print stations, and wherein said furnishing feature comprises at least one of a print image and a décor image.

5. The apparatus of claim 4, wherein each circulating print station comprises a plurality of print heads for application of different inks and/or fluids.

6. The apparatus of claim 1, wherein said outlet apparatus is disposed downstream of said furnishing carousel, and wherein said outlet apparatus comprises holding elements for anti-rotational discharge of said containers.

7. The apparatus of claim 6, wherein said outlet apparatus comprises a star-shaped outlet apparatus, wherein said holding elements comprise suction elements to prevent rotation, wherein said holding elements are disposed on a periphery of said star-shaped outlet apparatus, and wherein said suction elements are connected to a vacuum pump.

8. The apparatus of claim 6, wherein said holding elements comprise holding-and-centering tulips that prevent rotation, wherein said tulips are disposed on a head transport arranged above said containers, and wherein said tulips can be driven by said head transport.

9. The apparatus of claim 1, said furnishing carousel comprises a plurality of guides for containers.

10. The apparatus claim 9, wherein said guides comprise a bottom guide and a top guide, wherein said bottom guide comprises a turntable, and wherein said top guide comprise a packing-and-centering tulip.

11. The apparatus of claim 1, wherein said grouping device comprises a linear transporter that is arranged downstream of said outlet apparatus, wherein said containers can be combined on said linear transporter to form bundles and to be transported onward.

12. The apparatus claim 1, wherein said handling apparatus comprises plural application elements, wherein said application elements are disposed one after another in a direction of rotation of said furnishing carousel.

13. The apparatus of claim 1, wherein said handling apparatus further comprises plural application elements, and wherein at least two of said application elements are arranged one above the other.

14. A method of using an apparatus for handling containers and/or for producing bundles from labeled and/or decorated containers said apparatus comprising a handling apparatus, said handling apparatus comprising a container input, a furnishing carousel, a furnishing module, an application element, and a grouping device, wherein said furnishing carousel rotates about a central axis, wherein said furnishing module is in a region of said furnishing carousel, wherein said application element is in said region of said furnishing carousel, wherein said furnishing module applies a furnishing feature to a surface of a container, wherein said application element applies adhesive to said container on a surface outside that surface of a container that is provided with a furnishing feature by said furnishing module, and wherein said grouping device is selected from the group consisting of a compartmenting unit and a compacting section, wherein said grouping device is provided immediately after said furnishing carousel and/or an outlet apparatus, wherein said grouping device causes grouping, compacting, and temporary pressing together of a predetermined number of containers, and wherein said container input is selected from the group consisting of a single-track container feed, a multi-track container feed, a single-track container stream, and a multi-track container stream, whereby said containers are combined to form a bundle and transported onward, said method comprising using said apparatus to produce bundles from labeled containers, wherein using said apparatus to produce bundles from labeled containers comprises, on said furnishing carousel, providing said containers with a furnishing feature, said furnishing feature being one of a label and a print image, applying adhesive to said containers, discharging said containers out of said furnishing carousel by way of said outlet apparatus, and, in said grouping device, forming container bundles from a number of containers by sticking said containers to each other using said adhesive.

* * * * *